US005088720A

United States Patent [19]

Beeman et al.

[11] Patent Number: 5,088,720

[45] Date of Patent: Feb. 18, 1992

[54] ENVELOPE HANDLING SYSTEM

[75] Inventors: John A. Beeman, Dayton, Ohio; Floyd R. Solt, Garland, Tex.; James L. Leep, Martin, Mich.; Wayne S. Marvin; Troy F. Smith, both of Kalamazoo, Mich.

[73] Assignee: The Mead Corporation, Dayton, Ohio

[21] Appl. No.: 533,563

[22] Filed: Jun. 5, 1990

Related U.S. Application Data

[63] Continuation of Ser. No. 4,365, Jan. 16. 1987, Pat. No. 4,930,977.

[51] Int. Cl.[5] ..... B65H 31/32

[52] U.S. Cl. ..... 271/189; 271/218; 414/790.8

[58] Field of Search ..... 414/790.8; 271/176, 271/187, 189, 218, 315, 217

[56] References Cited

U.S. PATENT DOCUMENTS

| | | | |
|---|---|---|---|
| 2,850,281 | 9/1958 | Heimlicher et al. . | |
| 3,255,895 | 6/1966 | Klinger | 414/790.8 |
| 3,759,402 | 9/1973 | Hitch | 414/790.8 |
| 4,339,119 | 7/1982 | Sasaki et al. | 271/180 |
| 4,470,590 | 9/1984 | Ariga et al. | 271/187 |
| 4,511,136 | 4/1985 | Yamada et al. | 271/187 |
| 4,577,853 | 3/1986 | Duke | 271/217 |
| 4,593,896 | 6/1986 | Nakamura | 271/186 |
| 4,595,193 | 6/1986 | Nakamura | 271/187 |
| 4,966,521 | 10/1990 | Frye | 271/218 X |

*Primary Examiner*—Richard A. Schacher
*Attorney, Agent, or Firm*—Thompson, Hine and Flory

[57] ABSTRACT

An envelope handling system for removing envelopes from an upper level conveyor, placing them in stacks on a lower level bucket conveyor, removing the stacks from the bucket conveyor and side-loading them into cartons, sealing the cartons, conveying the cartons to a packing area, and forming the cartons into a horizontal column for placement into shipping containers. The system includes a spider feeder for removing the envelopes from an upper level conveyor and discharging them downwardly in a vertical direction, pivoting bottom fingers for receiving envelopes from the feeder and collecting them into a stack, hold back fingers for intercepting envelopes in a second stack above the bottom fingers, and transfer fingers for compressing a stack collected on the bottom fingers and urging the bottom fingers downwardly to place the stack onto the conveyor. A reciprocating ram urges a stack sidewardly from a bucket, a chute and pivoting gate members direct a stack into a set-up carton and compress the stack as it passes therethrough. Reciprocating tucker bars close upstream end flaps of the carton. A helical conveyor channel receives cartons from a sealing machine, orients the cartons to an upright position and deposits the cartons onto a horizontal surface. A reciprocating plate urges the cartons along a channel and a reciprocating platen urges the cartons sidewardly to form the horizontal column.

2 Claims, 11 Drawing Sheets

ENVELOPE HANDLING SYSTEM

This is a continuation of application Ser. No. 004,365, filed Jan. 16, 1987, now U.S. Pat. No. 4,930,977.

BACKGROUND OF THE INVENTION

The present invention relates to apparatuses for handling sheet-like articles, and more particularly, to apparatuses for stacking envelopes into stacks of a predetermined number, packing the stacks into cartons, sealing the cartons and transporting the sealed cartons to an area for loading into shipping containers.

The manufacture of envelopes of the type used to enclose folded documents such as letters, bills, and the like has been automated to the point wherein a single apparatus receives a web unwound from a roll of paper, cuts the web into planks, imprints, folds, and glues the blanks to form envelopes, and arranges the folded and glued envelopes at a discharge station in a horizontal column. An example of such a machine is a rotary reel-fed envelope machine manufactured by Winkler & Dunnebier. Once the envelopes are manufactured by such a machine, they must be separated into groups of a predetermined number, such as 50 or 100 envelopes, loaded into set-up cartons, and the cartons loaded into shipping containers. There also exist devices for separating the envelopes in the horizontal column into groups.

However, presently the groups of envelopes must be manually removed from a horizontal column formed by the envelope machine and placed into the open tops of set-up cartons. The cartons are then transported to a sealing machine and the cartons discharged from the sealing machine must be manually loaded into shipping containers.

In view of the unavoidable hazards present with the manual loading of envelopes into a set-up carton due to the properties of the paper forming the envelopes, and the chance for error resulting from the repeated performance of a manual task, it is desirable to automate this portion of the envelope handling system as well. Suggestions for such automation may be found in several patents.

For example, the Yamada et al. U.S. Pat. No. 4,511,136 discloses a sheet handling device in which a spider feeder feeds sheets traveling horizontally from an upper level conveyor and deposits them into a vertical stack on a lower level conveyor. The apparatus includes reciprocating fingers which are projectable into and out of a sheet stacking zone so that sheets may be collected above the lower level conveyor in order to provide sufficient time for the lower level conveyor to index a completed stack away from the stacking zone. A disadvantage with such a device is that it is incapable of handling freshly folded envelopes which contain air and must be compressed to a height which approximates the thickness of the carton into which they will be packed.

A device for compressing stacks is disclosed in the Sasaki et al. U.S. Pat. No. 4,339,119. That patent discloses a sheet stacking apparatus in which reciprocating rods are projected into a stacking zone to catch sheets discharged by an upper level conveyor and accumulate the sheets into a shack. The apparatus includes a "beat member" which presses against the sheets and compresses them against the rods.

A disadvantage with the device disclosed in the Sasaki et al. patent is that it cannot be used with a spider feeder mechanism such as that shown in the Yamada et al. patent. A spider feeder mechanism is an important component in any such system since it provides a mechanism for receiving envelopes or other sheet-like articles from a high level conveyor and depositing them into a vertical stack at a lower level without permitting the envelopes or articles to tumble.

In order to automate that portion of the system in which stacks of articles are packed into set-up cartons, it is necessary to provide a mechanism which removes the articles from a conveyor and feeds them into the carton. Such a device is suggested in the Lister et al. U.S. Pat. No. 4,062,169. That patent discloses an apparatus for packing semi-compressable articles, such as towels, into preformed plastic bags open at one end. The apparatus includes a conveyor which transports the stack of towels to a reciprocating ram which, in turn, transports the stack sidewardly through a pair of gate members and into the preformed bag. The gate members include converging top and side walls for compressing and guiding the stack as it enters the bag.

A disadvantage of such a device is that it cannot be used with other automated equipment of the type which automatically sets up a carton and, subsequent to the carton being loaded with articles, transports the carton to a sealing device. In contrast, the Lister et al. apparatus requires that bags manually be placed in registry with the gate members and, after loading, be manually removed from engagement with the gate members.

Accordingly, there is a need for a system for receiving folded and glued envelopes from a reel-fed envelope machine, stacking the envelopes into vertical stacks into a bucket conveyor, packing the stacks of envelopes into set-up cartons, sealing the cartons, and transporting the sealed cartons to an area for loading in shipping containers. Such a system should be as fully automated at possible and preferably should be capable of use with currently available machines.

SUMMARY OF THE INVENTION

The present invention is a system for receiving envelopes from an envelope machine, arranging the envelopes in vertical stacks of a predetermined number, packing the stacks into set-up cartons, sealing the cartons, and transporting the cartons to an area for loading into a shipping container. The system is fully automated so that manual steps are not required until the cartons are placed into the shipping container.

The system includes a sheet stacking component having a spider feeder for receiving envelopes from the envelope machine and releasing them to fall in a vertical direction into a stacking zone, a pair of pivoting hold back fingers projectable into the stacking zone for interrupting a flow of articles from the blade wheel feeder, a pair of pivoting transfer fingers projectable into the stacking zone below the blade wheel feeder for compressing the height of a completed stack, and pivoting bottom fingers which are capable of moving upwardly to receive the initial sheets of the stack and then pivoting downwardly as the stack grows in height, eventually to lower the stack onto a bucket conveyor.

Both the hold back fingers and the bottom fingers are counterweighted so that initially they pivot upwardly to receive sheets, then gradually pivot downwardly as the stacks they support grows in size and weight. In contrast, the transfer fingers are pivoted by a double-acting cylinder motor so that they are capable of urging a completed stack supported on the bottom fingers downwardly to place that stack onto a bucket conveyor and, at the same time, compress the stack.

The stacking apparatus also includes a misfeed detector which is positioned above the associated bucket conveyor and slightly downstream of the stacking zone. The misfeed detector includes a pair of L-shaped members attached to a transverse axle pivotally supported on a frame attached to the conveyor. Should a stack be misfed onto a bucket, the resulting increase in height will cause the stack to contact one or both of the L-shaped members causing the axle to pivot and trip a sensor which sends a signal to a control to stop the loading operation.

In operation, the spider feeder initially deposits envelopes into a first vertical stack upon the bottom fingers which have been pivoted upwardly by the counterweight. After a predetermined number of envelopes have collected on the bottom fingers, the hold back fingers project into the stacking zone and interrupt the flow of envelopes to the bottom fingers so that envelopes begin collecting upon the hold back fingers in a second stack. At the same time, the transfer fingers project into the stacking zone below the hold back fingers and are urged downwardly to lower the first stack onto a bucket conveyor. The conveyor indexes forwardly to remove the loaded bucket from the stacking zone and replace it with an empty bucket for the second stack.

At this time, the double-acting cylinder motor pivots the transfer fingers upwardly, allowing the bottom fingers to pivot upwardly in response to the counterweight, and the transfer and hold back fingers retract from the stacking zone allowing the partially collected second stack to fall upon the bottom fingers, and the cycle begins again. The advantage of this component of the system is that it receives envelopes from an envelope machine in a continuous manner, collects them into discrete, vertical stacks, partially compresses the stacks, and loads the stacks onto a bucket conveyor, all without interrupting the continuous operation of the envelope machine.

The envelope packing component of the system includes a ram for displacing a stack of envelopes from the conveyor toward a set-up carton in a packing zone, a chute for conveying a stack from the bucket, and a pair of gate members for conveying the stack from the chute to the interior of the carton. The ram is connected to a double-acting cylinder motor and the gate members are pivoted by rotary actuators between a loading or open position, in which they extend into the carton interior, and a closed position. The walls of the chute and gate members converge so that a stack is compressed and aligned as it passes from the conveyor to the set-up carton.

The cartons are set-up by a carton machine of known design which also includes a sealing component that folds the end flaps of the cartons, seals the cartons and discharges the sealed cartons to be conveyed to the carton packing area. The carton machine includes front and rear tucker bars which have been modified to maintain the bottom panel end flaps of a loaded carton closed prior to the time the carton enters the sealing apparatus, without deflecting the top panel end flaps of the carton. The rear tucker bar is actuated first so that it provides a backstop for preventing the envelopes from protruding from the opposite, open end of the carton. The front tucker bar is actuated after the ram is withdrawn from the carton to close the front bottom panel end flap of the carton.

At the beginning of the operation sequence for the envelope packing apparatus, the carton machine sets up a folded carton blank in a packing zone so that its front open end is in registry with the gate members, and the gate members pivot to a packing configuration in which their outer ends extend within the interior of the carton. The ram then displaces a stack sidewardly from a bucket on the conveyor through the chute, the pivoted gate members, and into the interior of the set-up carton. The ram withdraws from the carton and, as it clears the gate members, the gate members pivot to a position in which the members are withdrawn from the carton interior and are aligned parallel to the direction of travel of the carton. The front tucker closes the bottom panel end flap, and the packed carton is transported from the packing zone to the sealing machine.

Another component of the system is a carton transporting apparatus which is designed to be used in combination with a sealing apparatus of the type having a top discharge in which the packed cartons are lying on a side panel. The transporting apparatus includes a helical channel which receives the cartons from the sealing apparatus and rotates the cartons to an upright position. A reciprocating plate positioned above the sealing apparatus urges cartons emerging from the sealing apparatus along the helical channel.

The terminal portion of the channel is supported in a horizontal surface, such as work table, and includes a reciprocating platen. The reciprocating platen urges the cartons deposited on the table in a direction perpendicular to the direction of travel along the channel so that the cartons form a horizontal column in which side pannels of the cartons abut.

In a preferred embodiment, the helical channel includes a raised portion adjacent to the terminal portion of the channel which contacts the bottom panels of the cartons and prevents more than a single carton from being deposited upon the horizontal table at a time.

A specific carton has been designed for use with this envelope handling system. This carton includes a full bottom panel, front and rear side panels, and two partially-overlapping partial top panels connected to the side panels at score lines. Only one of the partial top panels is provided with a pair of opposing end flaps; the other partial top panel is "flapless."

In this configuration, gaps are formed between the end flaps of the partial top panel and the end flaps of the side panel adjacent to the flapless partial top panel. When used in the carton handling apparatus comprising the envelope packing component of the envelope handling system, the carton is set up such that the top panels face downstream towards the sealing apparatus. When the tucker bars are actuated, they are able to contact and close the upstream bottom panel end flaps, extend across the open ends of the carton, through the gaps below the top panel end flaps, and terminate beyond the top panel of the carton.

This allows the ends of the cartons to be completely closed to prevent envelopes within the interior from escaping, and forms a continuous guide which abuts the flaps closing rails of the sealing apparatus so that the likelihood of the bottom panel end flaps opening prior to the carton entering the sealing apparatus is minimized.

Accordingly, it is an object of the present invention to provide an envelope handling system in which envelopes are removed from a high level conveyor and released to fall into a vertical stack with a minimum of tumbling; an envelope handling system in which envelopes are taken from a continuously operating envelope machine and stacked in stacks of predetermined sized on a bucket conveyor without interrupting the operation of the envelope machine; an envelope handling system which automatically removes stacks of envelopes from a bucket conveyor and packs the stacks into set-up cartons; an envelope handling system in which sealed cartons are transported to a loading area and arranged in a horizontal column to facilitate packing in shipping containers; a carton for use with an envelope handling system which facilitates the use of flap closing components; and an envelope handling system in which the number of manual operations required to stack envelopes, place the envelopes in cartons, and load the cartons in shipping containers is minimized.

Other objects and advantages of the present invention will be apparent from the following description, the accompanying drawings, and the appended claims.

DETAILED DESCRIPTION OF THE PREFERRED EMBODIMENT

Figure 1:
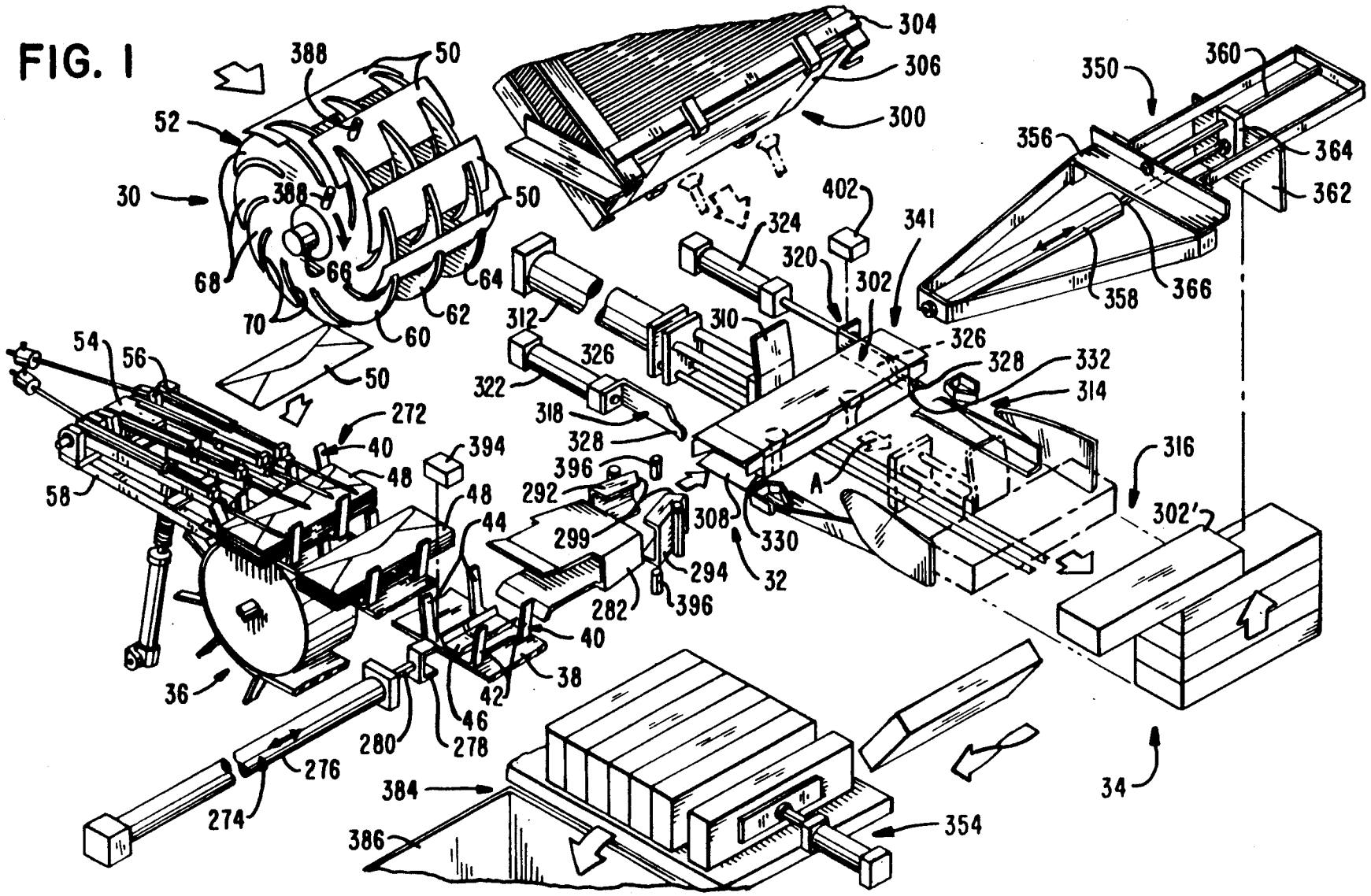
FIG. 1 is a schematic, perspective view of a preferred embodiment of the envelope handling system of the present invention.

As shown in FIG. 1, the envelope handling system of the present invention includes a sheet stacking component, generally designated 30, an envelope packing component 32, and a carton transporting apparatus 34. An endless bucket conveyor, generally designated 36, extends between the sheet stacking component 30 and the envelope packing apparatus 32.

The conveyor 36 includes a flexible belt 38 which supports a plurality of individual buckets 40. Each bucket 40 includes front and rear pairs of legs 42, 44, and a central, U-shaped channel 46 for supporting a stack 48 of envelopes 50.

SHEET STACKING APPARATUS

Figure 2:
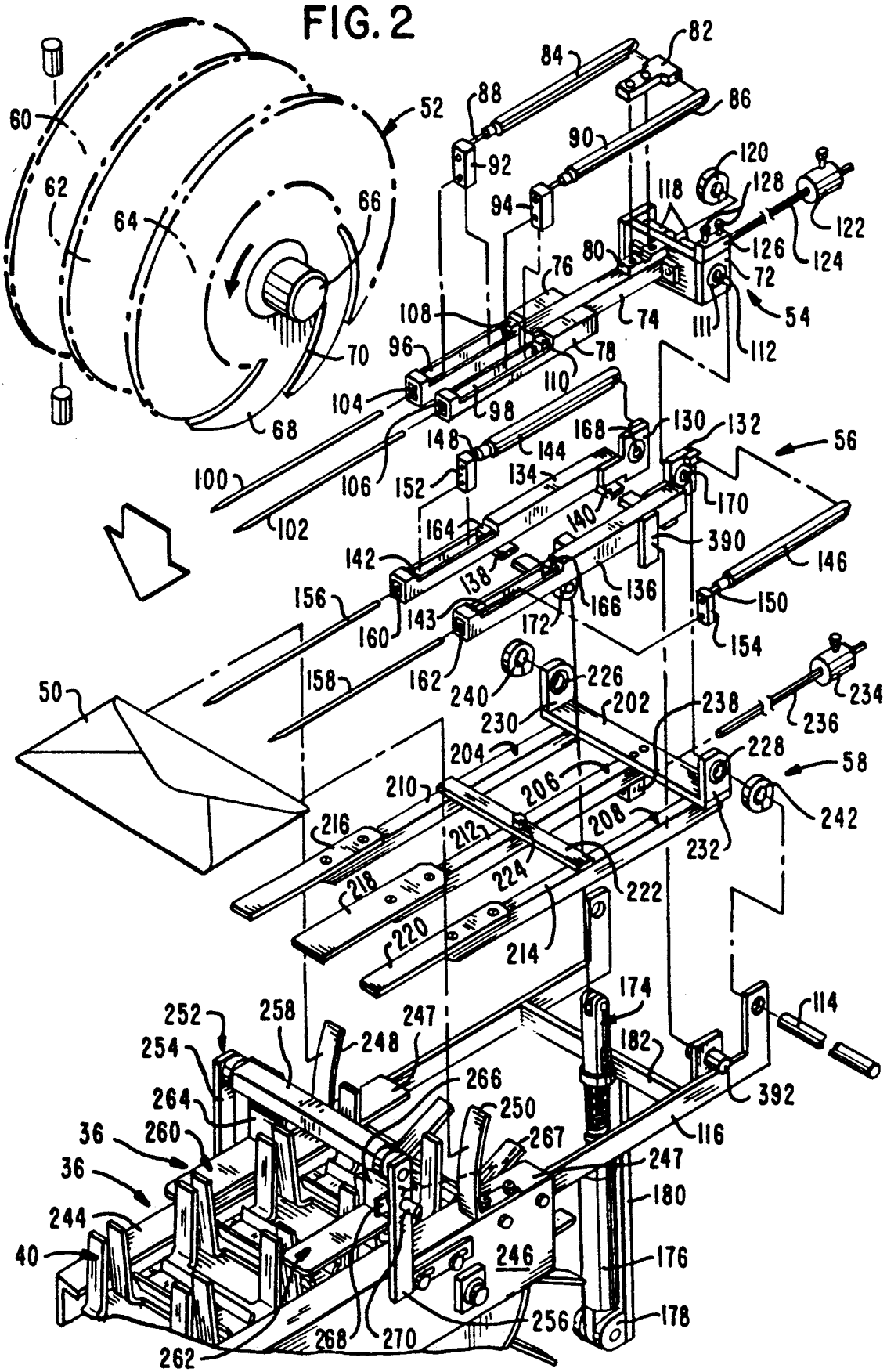
FIG. 2 is an exploded, perspective view of the envelope stacking component of the system of FIG. 1.
Figure 3:
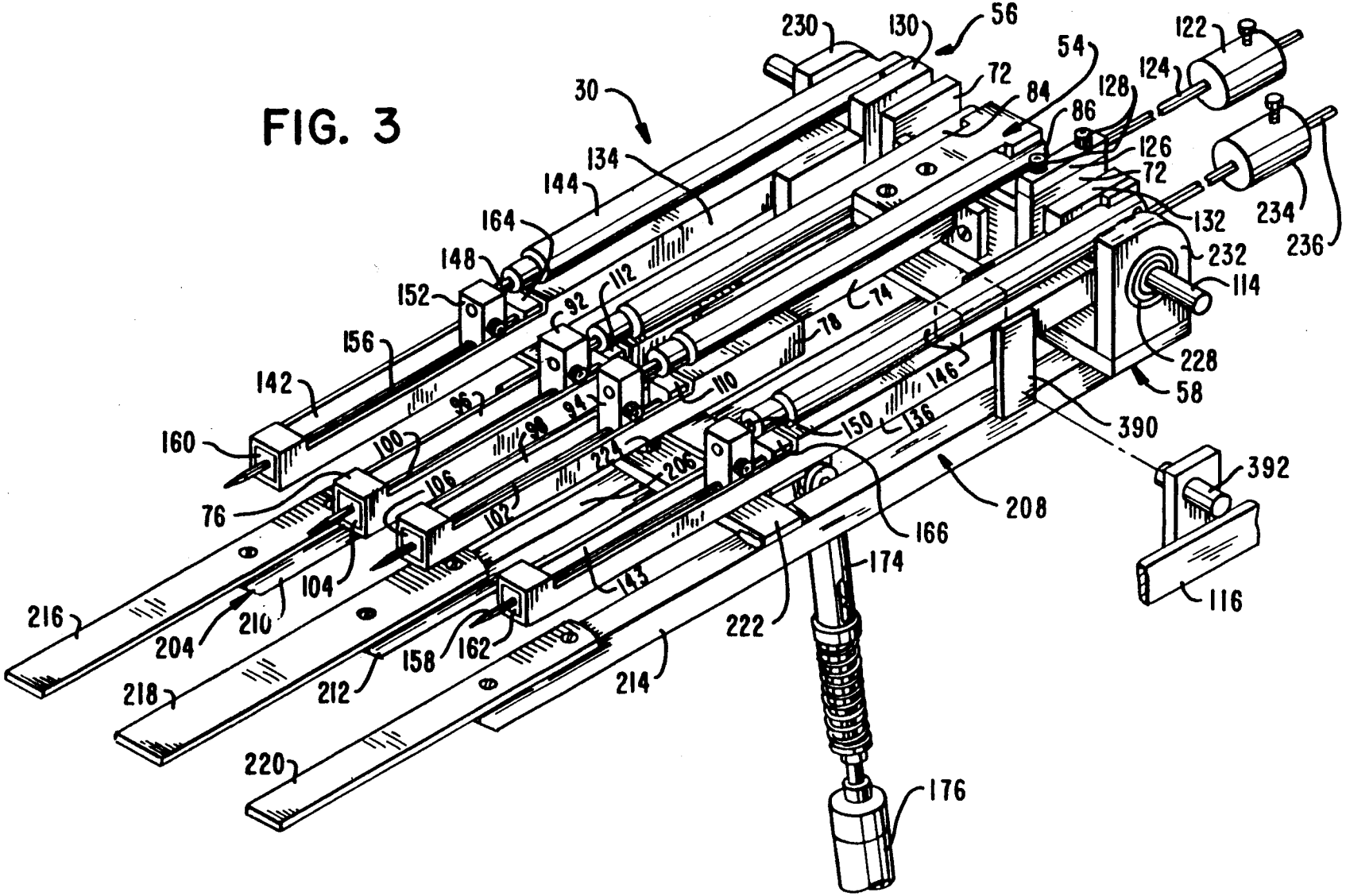
FIG. 3 is a perspective, partially exploded view of a detail of the stacking component of FIG. 2, showing the hold back fingers, transfer fingers, and bottom fingers.

As shown in FIGS. 1, 2, and 3, the sheet stacking component includes a spider feeder, generally designated 52, hold back fingers 54, transfer fingers 56, and bottom fingers 58. The spider feeder 52 comprises three disks 60, 62, 64 which are spaced from each other and mounted on a common axle 66. Each of the disks 60–64 includes a plurality of arcuate, tapering arms 68 spaced about its periphery and separated from each other to form slots 70 shaped to receive envelopes 50.

The spider feeder 52 is positioned to receive envelopes from the output conveyor of an envelope machine (not shown). A typical machine which may be used with the system of the present invention is a Helios 399 G/GS rotary reel-fed envelope machine, manufactured by Winkler & Dunnebier, GmbH & Co. KG, Neuwied, West Germany.

The hold back fingers 54, transfer fingers 56 and bottom fingers 58 are positioned below and rearwardly of the spider feeder 52. As shown in FIGS. 2 and 3, the hold back fingers 54 include a U-shaped mounting bracket 72, a forwardly extending strut 74, and a pair of mounting channels 76, 78 attached to opposite sides of the strut. The strut 74 includes a boss 80 at its base adjacent to the bracket 72, and the boss receives a mounting block 82. Left and right double-acting cylinder motors 84, 86, respectively, are attached to the mounting block 82 and includes rods 88, 90 attached to slide blocks 92, 94.

The slide blocks 92, 94 are seated in longitudinal slots 96, 98 formed in the mounting channel 76, 78, respectively, and receive the rearward ends of left and right hold back pins 100, 102. The hold back pins 100, 102 extend through holes formed in forward bearing blocks 104, 106 and are seated, when retracted, within rearward bearing blocks 108, 110, attached to opposite ends of longitudinal channels 96, 98, respectively.

Actuation of the cylinder motors 84, 86 such that the rods 88, 90 extend outwardly causes the slide blocks 92, 94 to travel within the channels 96, 98 and displace the pins 100, 102 outwardly from the mounting channels 76, 78. The longitudinal slots 96, 98 are sized such that displacement of the slide blocks 92, 94 to the rear of the slots causes the rods 100, 102 to retract completely within the mounting channels 76, 78.

The bracket 72 includes journal bearing 111 forming a transverse bore 112 which is journaled onto an axle 114. The axle 114 is attached to a frame 116 which, in turn, is mounted on and extends rearwardly from the conveyor 36. The hold back fingers 54 are centered on the axle by means of a clevis 118 that receives a shaft collar 120 fixed to an axle 114. The clevis 118 includes a transverse passage (not shown) which forms a part of the transverse bore 112 receiving the axle 114.

An adjustable counterweight 122 is mounted on a rod 124 which is attached to a mounting block 126 fastened to the bracket 72 by machine screws 128. The counterweight 122 is adjusted along the rod 124 such that its weight pivots the mounting channels 76, 78 about axle 114 upwardly toward the spider feeder 52.

The transfer fingers 156 include left and right mounting brackets 130, 132, respectively, which are attached to left and right mounting channels 134, 136. The mounting channels 134, 136 are separated by struts 138, 140 and include longitudinal slots 142, 143.

Double-acting cylinder motors 144, 146 are mounted on the mounting brackets 130, 132, respectively, and include rods 148, 150 attached to the upper portions of slide blocks 152, 154. The slide blocks 152, 154 ride in the longitudinal slots 142, 143 and are attached to transfer pins 156, 158, respectively. The pins 156, 158 are journaled into forward bearing blocks mounted on the forward ends of the channel 134, 136, 160, 162, and, when retracted, engage rearward bearing blocks 164, 166, placed at the rearward ends of the longitudinal slots 142, 143, respectively. The mounting brackets 130, 132 include journal bearings 168, 170 which receive the axle 114.

Mounting channel 146 includes a knuckle 172 which is attached to the clevis 174 of a double-acting cylinder motor 176. The cylinder motor 176 is pivotally attached to a clevis 178 that, in turn, is attached to a downwardly-extending bar 180. The bar 180 is connected to a transverse boss 182 forming and intergral part of the frame 116.

Figure 4:
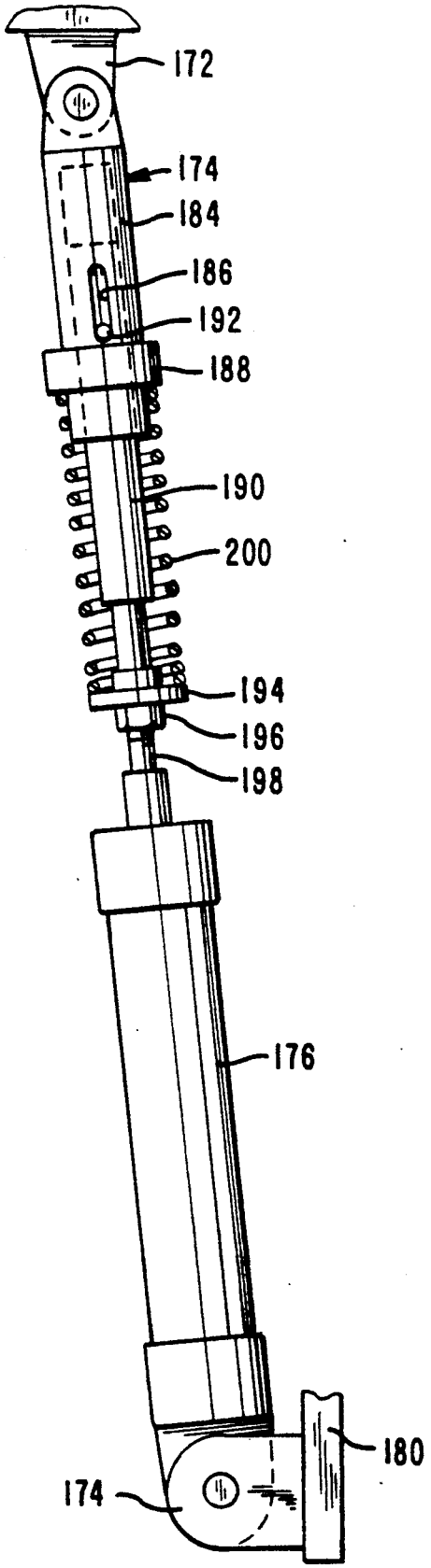
FIG. 4 is a detail showing the double-acting cylinder motor for actuating the transfer fingers shown in FIG. 3.

As best shown in FIG. 4, the clevis 174 includes a tubular portion 184 having a pair of longitudinal slots formed therein (only one of which is shown), and an annular shoulder 188. A cylindrical rod 190 telescopes into the tubular member 184 and includes a cross pin 192 which is captured within and slides along the slots 186. The rod 190 terminates at its lower end in a disk-shaped spring seat 194 that includes a mounting nut 196 receiving the end of the cylinder rod 198 of the cylinder motor 176. A coiled spring 200 is captured between the annular shoulder 188 and spring seat 194, which are spaced apart sufficiently to allow the spring to urge the rod 190 out of the tubular member 184 and drive the pin 192 against the bottom of the seat 192.

The bottom fingers 58 include a U-shaped yoke 202 and three finger elements 204, 206, 208. The finger elements 204–208 include rectangular bars 210, 212, 214 which are attached at their bases to the yoke 202 and terminate in finger plates 216, 218, 220, respectively. A crossbar 222 extends transversely of and is attached to the bars 210–214, and includes a resilient boss 224 which is positioned to contact the underside of strut 138 of the transfer fingers 56.

The yoke 202 includes journal bearings 226, 228 which are sized to receive the axle 114, and are carried on upright mounting brackets 230, 232 that are spaced apart sufficiently to receive the transfer fingers therebetween. A counterweight 234 is adjustably mounted on a rod 236 extending rearwardly from the yoke 202. The forward tip of the rod 236 is fixed to a boss 238 mounted on the underside of the finger element 206. The yoke 202 is centered on the axle 114 by shaft collars 240, 242.

The conveyor 36 on which the sheet stacking apparatus is mounted includes a pair of inverted, L-shaped side channels 244, 246 which open inward and face the buckets 40. The stacks 48 of envelopes 50 (see FIG. 1) travel within the channels and are maintained in their compressed configuration by the upper horizontal surfaces 247 of the channels 244, 246 as they are conveyed toward the envelope packing apparatus 32. A pair of separator bars 248, 250 are mounted on the upper surfaces of the side channels 244, 246 and, as will be explained, operate to remove envelopes 50 from the slots 70 of the spider 52. Preferably, the separator bars 248, 250 are arcuate in shape, having as centers of curvature the axle 114.

The conveyor 36 includes a misfeed detector 252 which includes upright members 254, 256 attached to the side channels 244, 246, respectively, which in turn support a transverse axle 258. Attached to the transverse axle are a pair of L-shaped members 260, 262 that include vertical components 264, 266, respectively. Vertical component 266 includes a detent (not shown) which engages a dimple 267 in upright member 256 when the components are aligned with the members. The detent provides a "break away" action for the L-shaped members.

Vertical component 266 includes a trip plate 268 which is positioned adjacent to a proximity switch 270 mounted on the upright member 256. A stack of envelopes indexed forwardly in a bucket 40 which includes envelopes above the side channels 244, 246 will impact the L-shaped members 260, 262 and cause the axle 258 to rotate, removing the trip plate 268 from the immediate vicinity of the proximity switch 270, thereby generating a signal indicating that a jam or a misfeed has occured.

Figure 5:
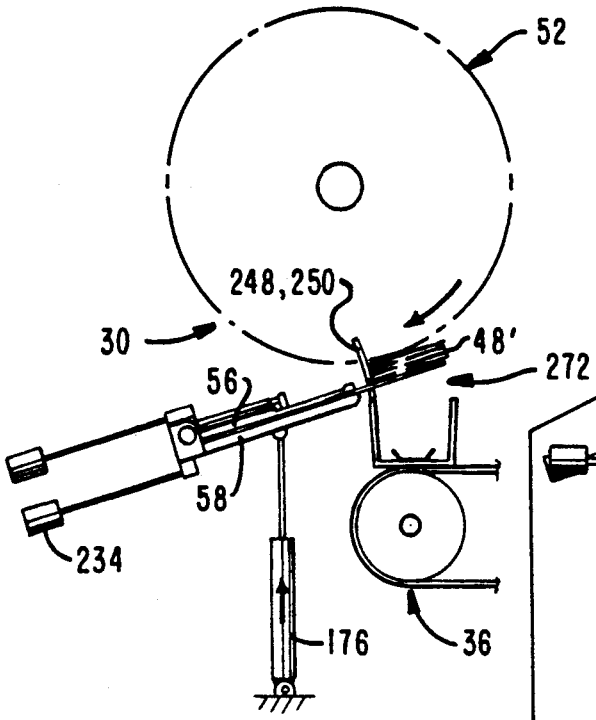
FIGS. 5, 6, 7, and 8 each are schematic side elevations of the sheet stacking component shown in FIG. 2, and progressively show the continuous removal of envelopes from the spider feeder and the loading of the envelopes onto an associated bucket conveyor.

The operation of the sheet stacking apparatus is as follows. As shown in FIG. 5, envelopes 50 are conveyed from an upper level conveyor (not shown) to a stacking zone 272 by the spider feeder 52, where they contact the separator bars 248, 250 and are removed from the spider feeder disks 60, 62, 64 (see FIG. 1). At this time, the hold back pins 100, 102 and transfer pins 156, 158 have been withdrawn within their respective mounting channels 76, 78, 134, 136, and the cylinder motor 176 has been actuated to pivot the transfer fingers 56 to an upward position. This allows the bottom fingers 58 to pivot upwardly as well in response to the force exerted by the counterweight 234.

As the envelopes 50 fall from the spider feeder 52, they collect in a first stack 48 upon the bottom fingers 58. By permitting the bottom fingers 58 to pivot upwardly as shown in FIG. 5, the distance the envelopes 50 fall before collecting into the stack 48 is minimized, thereby minimizing the likelihood of a misaligned stack. The counterweight 234 is adjusted such that the bottom fingers 58 pivot downwardly in response to the increasing weight of the first stack 48 collecting upon it.

As the envelopes 50 slide out of slots 70 of the spider feeder 52, they exert a downward force on the hold back and transfer fingers 54, 56, respectively. Hold back fingers 54 pivot downwardly in response to this force, while the spring-loaded clevis 174 (FIG. 4) allows the transfer fingers 56 to pivot slightly downwardly.

Figure 6:
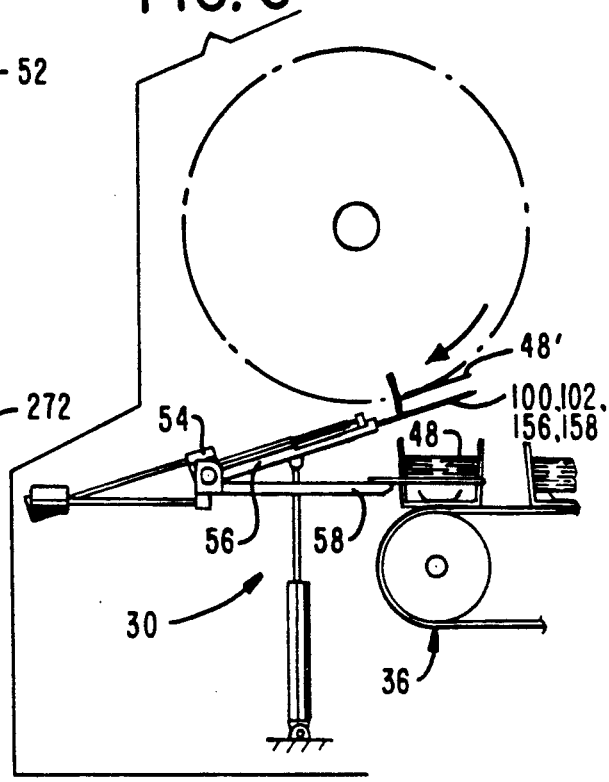

As shown in FIG. 6, when a predetermined number of envelopes 50 have been collected upon the bottom fingers 58, the cylinder motors 84, 86 of the hold back fingers 54 and the cylinder motors 144, 146 of the transfer fingers 56 are actuated to displace their respective pins 100, 102, 156, 158 outwardly (see FIG. 2). Consequently, successive envelopes 50' leaving the spider feeder collect upon the hold back pins 100, 102 of the hold back fingers 54 in a second stack 48'.

Figure 7:
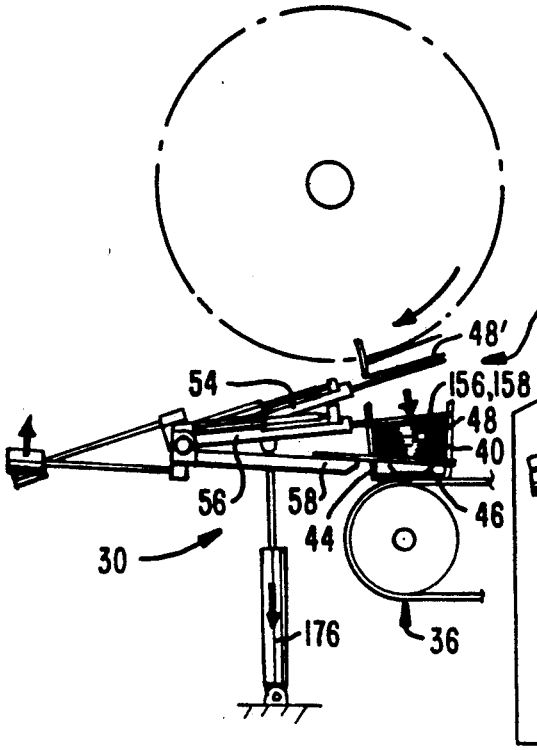
Figure 8:
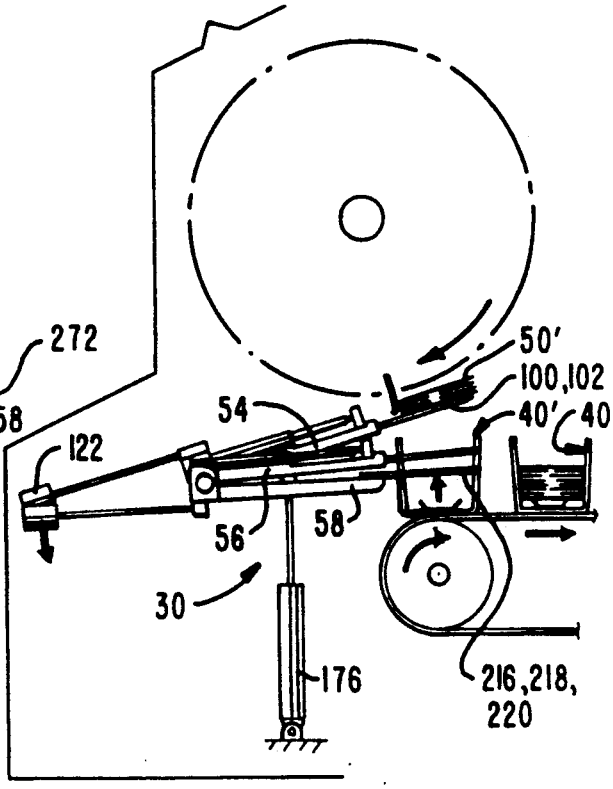

As shown in FIG. 7, the cylinder motor 176 is actuated to pivot the transfer fingers 56 downwardly, which causes the transfer pins 156, 158 to bear down against the topmost envelope of the completed first stack 48. This downward force compresses the stack and urges the bottom fingers 58 downwardly to place the stack within the bucket 40 of the conveyor 36. The finger plates 216, 218, 220 (see FIG. 2) are spaced such that the rear legs 44 of the bucket extend between them. Once the stack 48 has been lowered so that it rests upon the channel 46, the conveyor 36 is actuated to index the loaded bucket forwardly, thereby removing that bucket from the bottom fingers 58 in the stacking zone 272 and presenting an empty bucket 40' into the stacking zone, as shown in FIG. 8.

At this time, the cylinder motor 176 is actuated to pivot the transfer fingers 156 upwardly, which allows the bottom fingers 58, now empty, to rise to the position shown in FIG. 5. At that time, all four pins 100, 102, 156, 158 are retracted to allow the stack 50', which had been collecting upon the hold back pins 100, 102, to fall upon the fingers 216, 218, 220 of the bottom fingers 58.

It should be noted that the counterweight 122 of the hold back fingers 54 is adjusted such that the hold back pins 100, 102 are pivoted downwardly under the increasing weight of the collected stack 50'. Consequently, the distance that a released envelope must fall is maintained at a minimum and is consistent for every envelope collected into the stack 50'.

ENVELOPE PACKING APPARATUS

Figure 9:
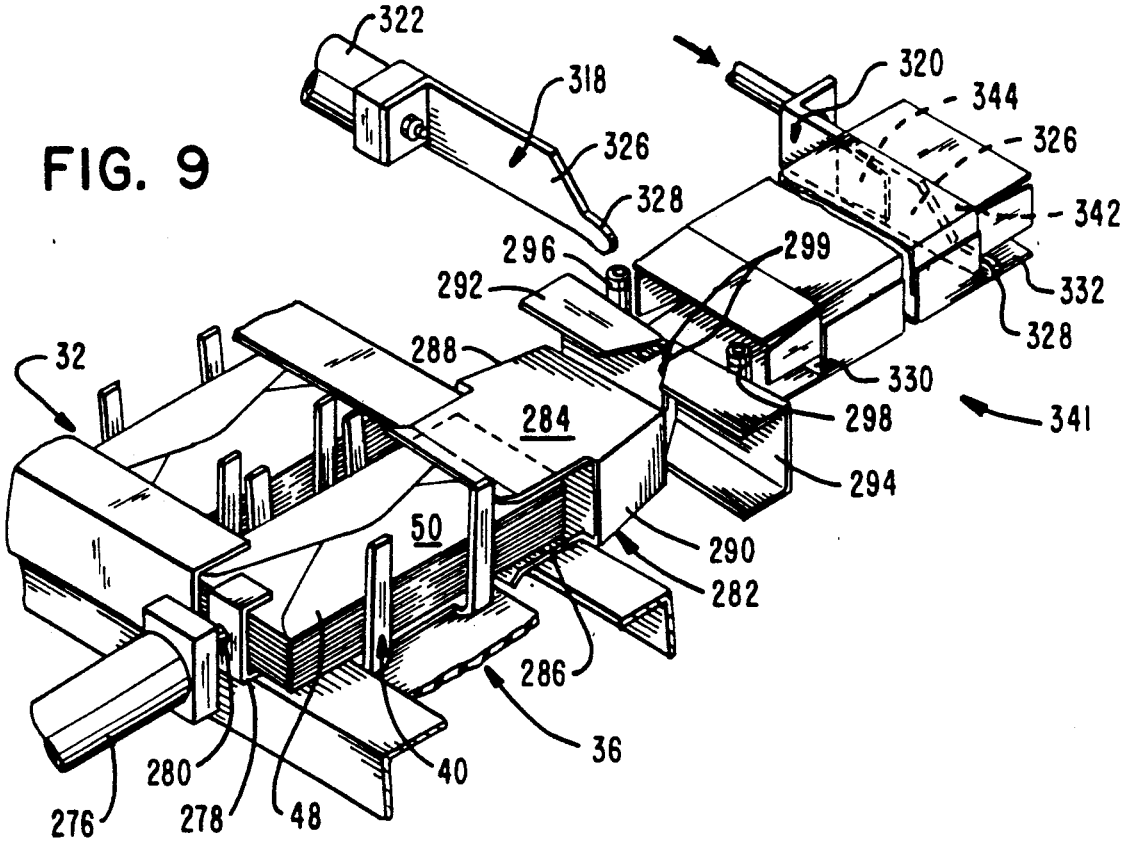
FIGS. 9, 10, 11 and 12 are each details showing, in perspective, the envelope packing component of the system of FIG. 1, and show, in sequence, the operation of packing a stack of envelopes into a set-up carton.

As shown in FIGS. 1 and 9, the envelope packing apparatus 32 includes a ram 274 consisting of a double-acting cylinder motor 276 having a C-shaped bracket 278 attached to the end of its rod 280. A chute 282 is positioned adjacent to the conveyor 36 opposite the ram 276 and includes converging top, bottom and side walls 284, 286, 288, 290, respectively, which act to compress and align a stack 50 of envelopes passing through it.

A pair of gate members 292, 294 are positioned on a side of the chute 282 opposite the conveyor 36 and are attached to vertical pivot shafts 296, 298 which are positioned by rotary actuators (not shown). The gate members 292, 294, each comprise a L-shaped channel having converging top and bottom walls, and a beveled outer end 299 to provide clearance when the members pivot between the open or packing position shown in FIG. 10, and the closed position of FIG. 9. The gate members 292, 294 are positioned adjacent to a carton machine, generally designated 300. The carton machine 300 is positioned to pull cartons 302 from a magazine 304 of carton blanks 306 and set-up the cartons such that its open end 308 is in registry with the gate members 292, 294. An example of such a carton machine 300 is the Econoseal E-System, manufactured by Econocorp, Inc., Needham Heights, Mass.

The carton machine 300 includes a horizontal ram plate 310 which contacts and sets up the cartons 302, a double-acting cylinder motor 312 for displacing the ram plate in a downstream direction, a series of rails, generally designated 314, for closing the end flaps of the carton 302, and a sealing and cooling component, generally designated 316.

The carton machine 300 has been modified to include front and rear tucker bars 318, 320, which are attached to double-acting cylinder motors 322, 324, respectively. Each of the tucker bars 318, 320 includes a side plate 326 terminating in a rounded finger 328. The fingers 328 of the tucker bars 318, 320 are shaped to extend through gaps 330, 332 formed between the front and rear partial end flaps 334, 336, and the side flaps 338, 340 (see also FIG. 19).

The operation of the envelope packing apparatus is shown sequentially in FIGS. 9, 10, 11 and 12. After the carton machine 300 has set-up a blank 306 in a packing zone 341 (see also FIG. 1) to form a carton 302 with front and rear open ends 308, 342, cylinder motor 324 is actuated to displace rear tucker bar 320 forward, thereby closing rear bottom end flap 334 and blocking the rear open end 342 of the carton. The conveyor 36 is actuated to bring a bucket 40 loaded with a stack 48 of envelopes into registry with the chute 282.

Figure 10:
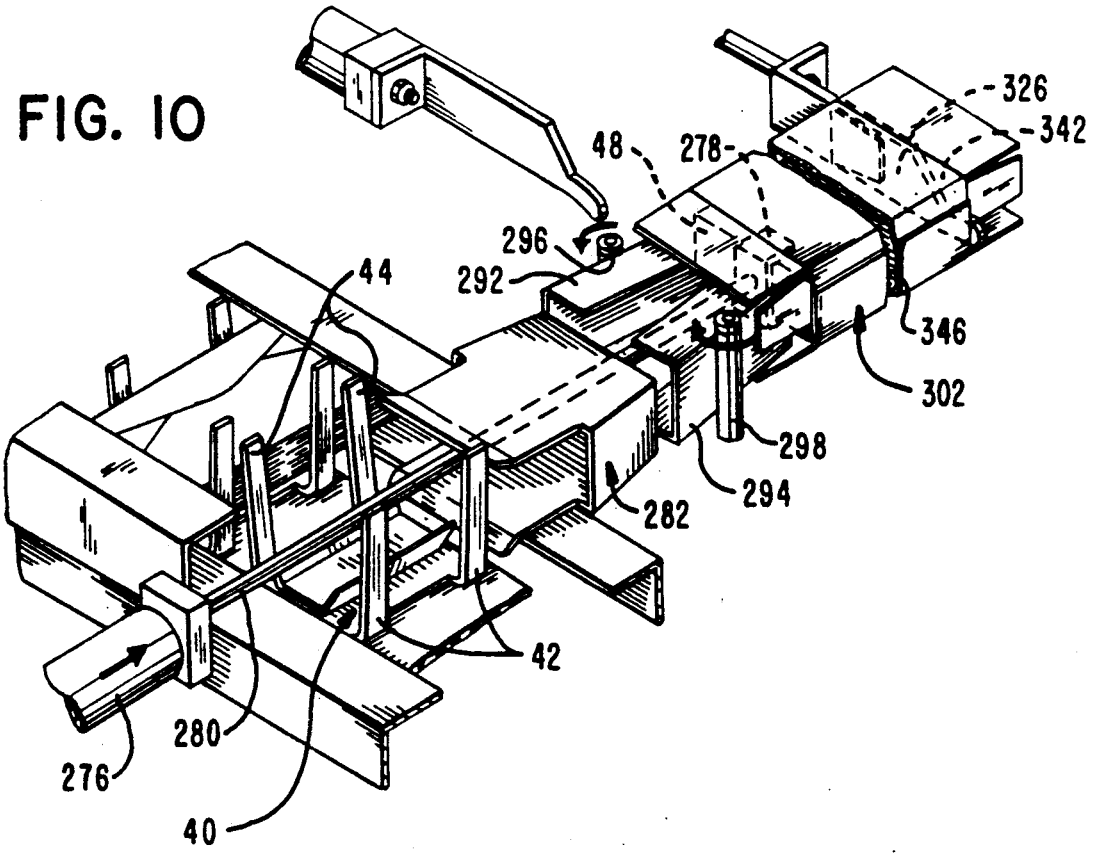

As shown in FIG. 10, gate members 292, 294 are pivoted about shafts 296, 298 such that their forward portions 299 enter the interior 346 of the carto 302, and the gate members are aligned with the chute 282 and are perpendicualr to a direction of travel of the carton, indicated by arrow A in FIG. 1.

Cylinder motor 276 of ram 274 is actuated to extend rod 280 so that C-bracket 278 displaces stack 50 from between the front and rear legs 42, 44 of the bucket 40 sidewardly through and gate members 292, 294, each of which compresses and aligns the stack, and into the interior 346 of the carton 302. The presence of the rear tucker bar 326 prevents the envelopes within the stack 48 from exiting the rear open end 342.

Figure 11:
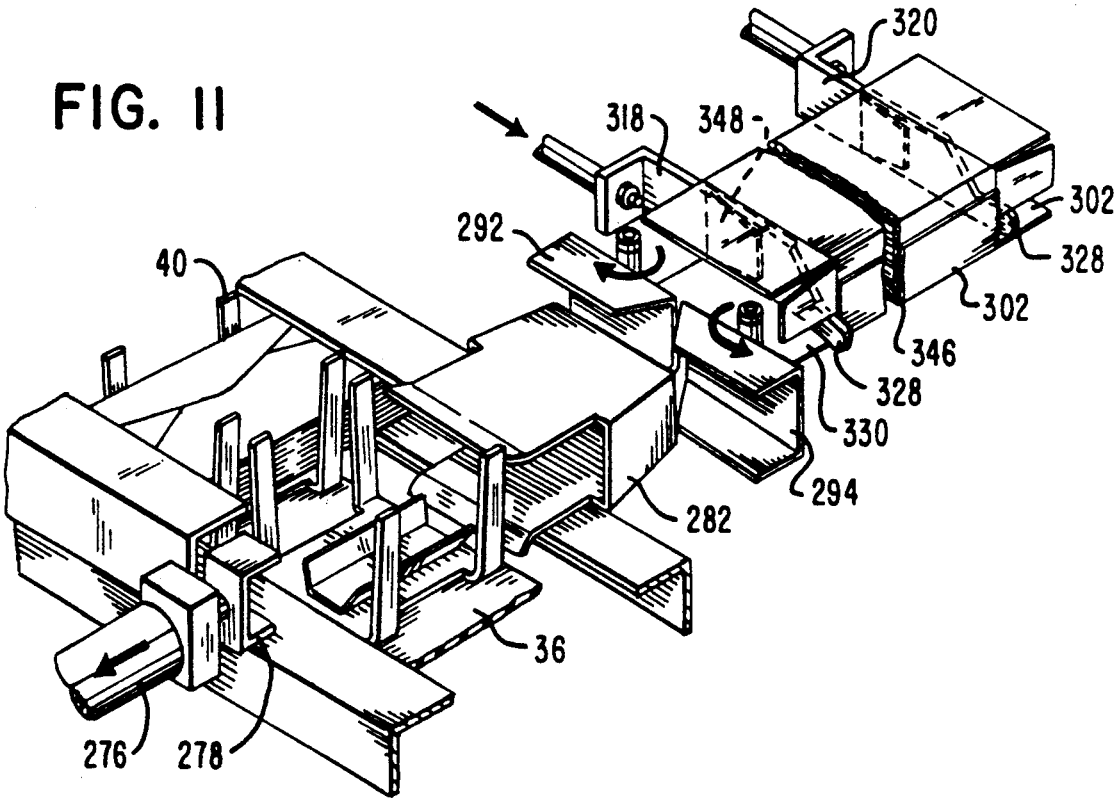

As shown in FIG. 11, the cylinder motor 276 is actuated to withdraw the bracket 278 to a position adjacent to the conveyor 36 opposite the chute 282, which provides clearance for the conveyor to index a next bucket 40 adjacent to the packing zone 341. At this time, the gate members 292, 294 are pivoted out of the interior 346 of the carton 302, thereby providing clearance for the carton to be displaced from the packing zone 341, in a downstream direction relative to the carton machine 300 (FIG. 1).

Rotation of the gate members 292, 294 also provide clearance for the front tucker bar 318 to be indexed forwardly to close the front bottom end flap 348. It should be noted that, at this time, the fingers 328 of the front and rear tucker bars 318, 320 protrude through the gaps 330, 332 present in the carton 302, so that there is a substantially continuous rail formed with the rails 314 of the sealing component 316 (FIG. 1) which prevents the front and rear bottom end flaps 348, 344 from springing open as the carton is displaced from the packing zone 341.

Figure 12:
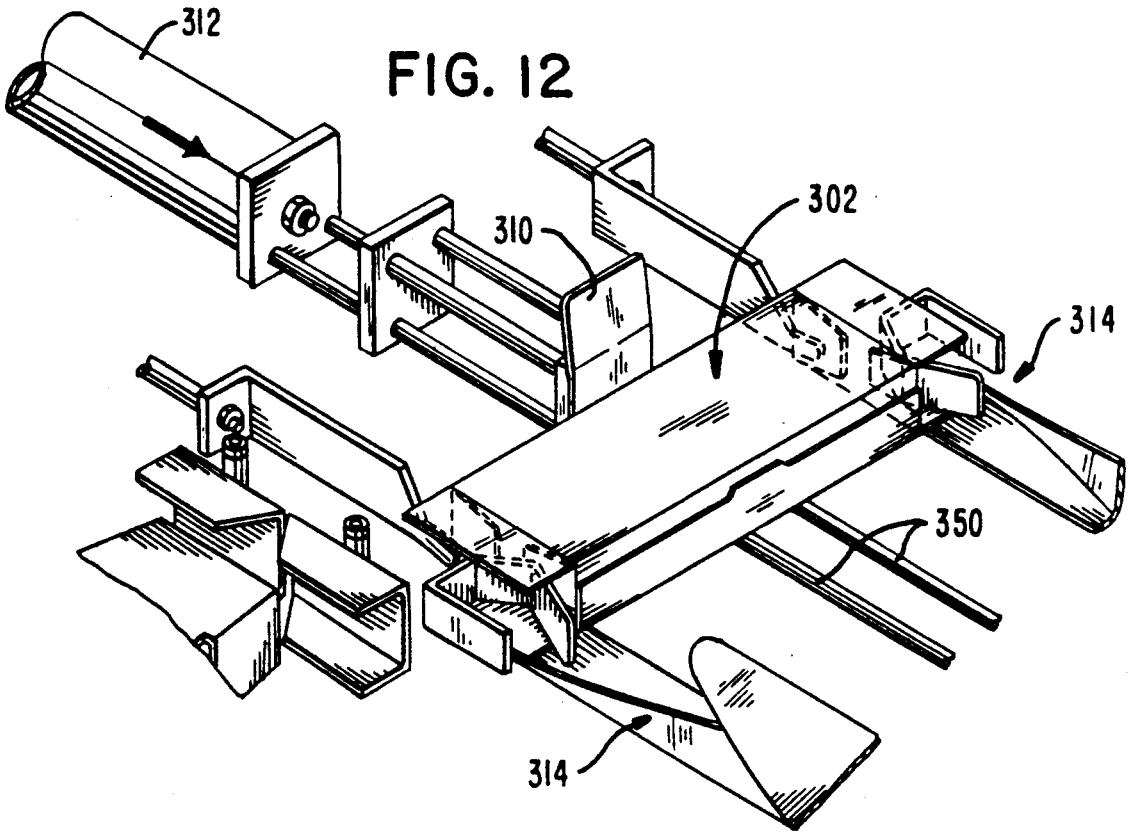

As shown in FIG. 12, the double-acting cylinder motor 312 is actuated to displace the ram plate 310 in a downstream direction from the packing zone 341 toward the sealing component 316, thereby displacing the loaded carton 302 along support rails 350 of the carton machine 300. After the cylinder 312 withdraws the ram plate 310 to its original position shown in FIG. 1, the cycle may begin again.

CARTON TRANSPORTING APPARATUS

Figure 13:
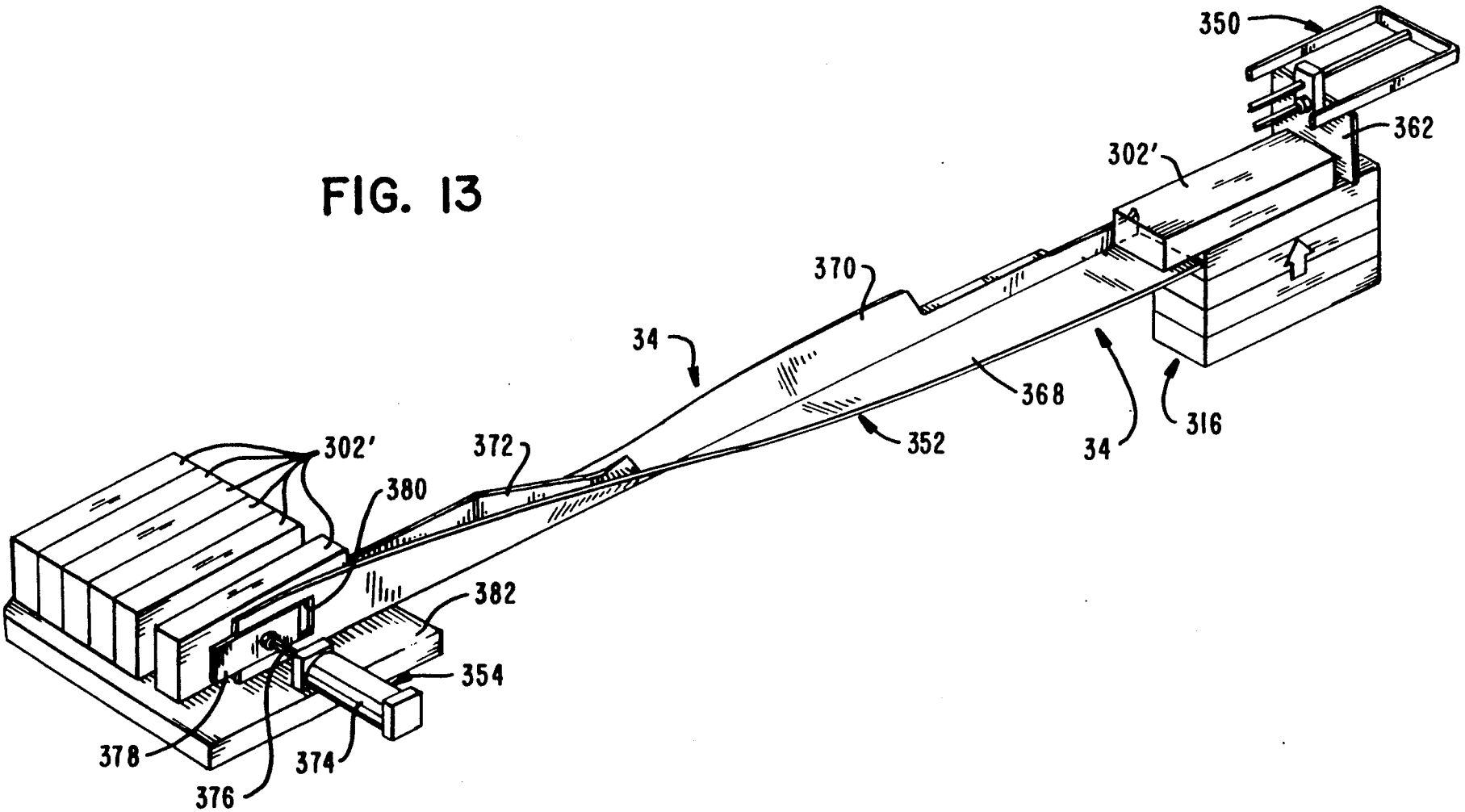
FIG. 13 is a perspective view showing the carton conveying component of FIG. 1.

As shown in FIGS. 1 and 13, the carton transporting apparatus 34 is used in combination with the carton sealing component 316 which receives loaded cartons at a lower level seals the end flaps of the carton, allows the adhesive to cool, and discharges sealed cartons 302' vertically. The transporting apparatus includes a pushing element 350, a helical channel 352, and a queuing component 354. The pushing element 350 includes a support frame 356, a double-acting cylinder motor 358, a longitudinal rod 360 and a pusher plate 362. The pusher plate includes a mounting bracket 364 which is journaled onto the longitudinal rod and is connected to the rod 366 of the cylinder 358. The pushing element 350 is oriented such that the actuation of the cylinder 358 causes the plate 362 to reciprocate in a direction that is aligned with the direction of travel of the channel 352.

The channel 352 includes a helical major wall 368 that is substantially horizontal at an end adjacent to the sealing component 316 and positioned to receive a sealed carton 302', and is substantially vertical adjacent to the queuing component 354. The major wall 368 is attached to a minor wall 370 which is substantially vertical adjacent to the discharge of the sealing component 316, and is substantially horizontal adjacent to the queuing component 354. The minor wall 370 includes an upwardly extending portion 372 which is positioned adjacent to the queuing component 354.

The queuing component 354 includes a double-acting cylinder motor 374 having a rod 376 that is connected to a horizontally-extending platen 378. The platen 378 is positioned within a terminal cut-out 380 formed in the major wall 368. The cylinder 374 is positioned adjacent to a support table 382 which forms a part of a container loading station, generally designated 384 (see FIG. 1). Preferably, the cylinder motor 374 is connected to the pneumatic system of the sealing component 316, as is the cylinder motor 358. Cylinder motors 374, 558 cycle simultaneously.

The operation of the carton transporting apparatus 34 is as follows. Sealed cartons 302' are discharged upwardly from the sealing component 316. As a carton 302' is raised to an elevation corresponding to the horizontal component of the major wall 368. and the double-acting cylinder motor 358 is actuated to draw the cylinder rod 366 inwardly, thereby displacing the pushing plate 362 toward the channel 352. This moves the carton onto the channel 352.

This process is repeated for successive sealed cartons, eventually loading the channel 352 with cartons 302' positioned end-to-end. The cartons are prevented from sliding all at once onto the support table 382 by the upwardly extending portion 372, which is positioned to prevent cartons from sliding freely thereover and allow only a single carton to slide onto the table at one time. As each carton is deposited on the table 382 in front of the queuing component 354, the cylinder motor 374 is actuated to displace the platen 378 outwardly, thereby moving the carton 302' in a direction perpendicular to its direction of travel along the channel 352.

Successive displacement of cartons deposited on the table forms a horizontal column of cartons 302' which are arranged such that their side panels abut each other. The cartons may then be loaded into shipping containers 386.

COMPUTER CONTROL

Figure 14:
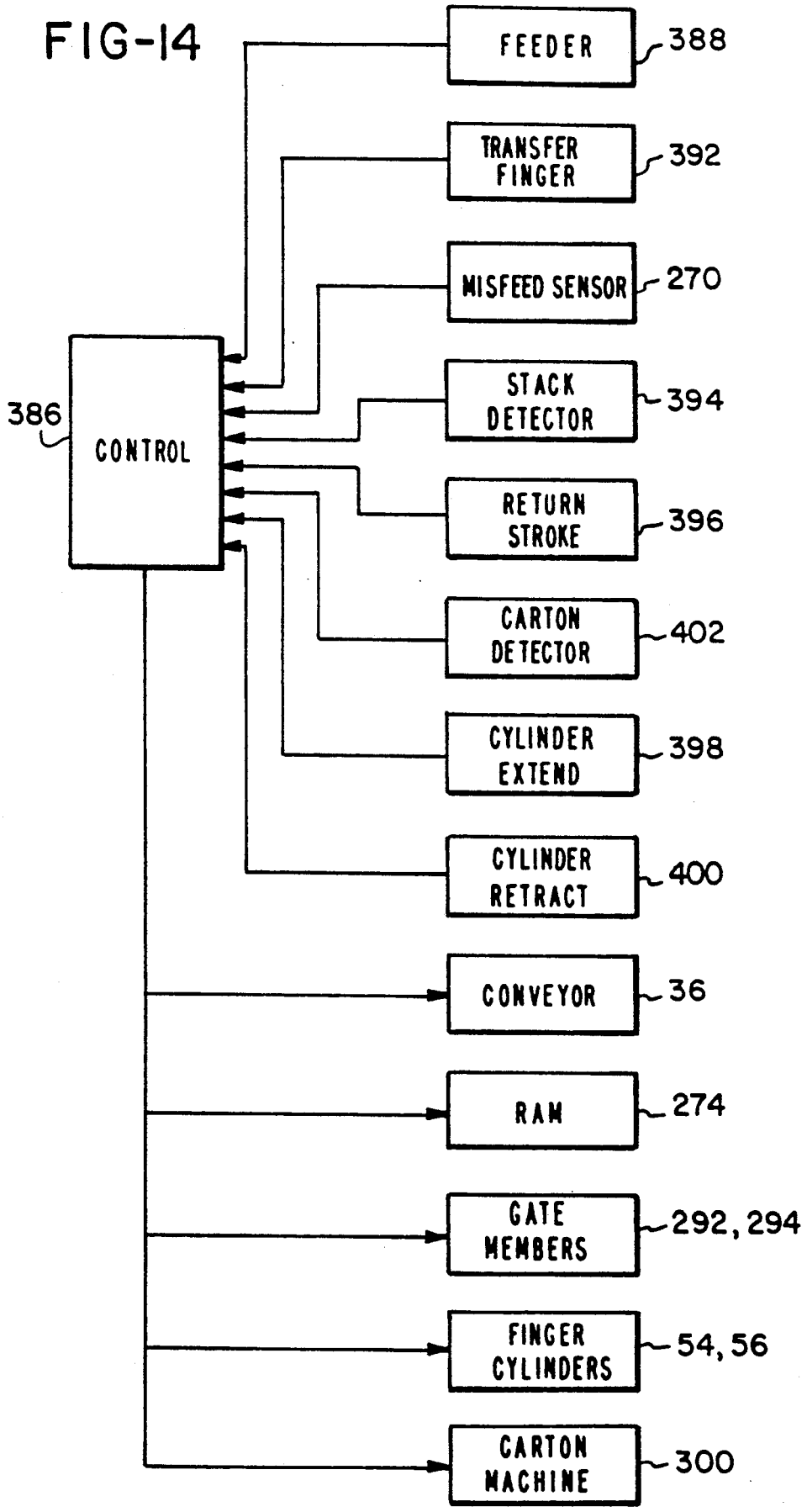
FIG. 14 is a diagram of the computer control of the embodiment of FIG. 1.

As shown schematically in FIG. 14, the sheet handling system of the present invention is operated automatically by a computer control 386. In the preferred embodiment, the control is a GE Series I programmable conroller manufactured by General Electric Corporation. As shown in FIGS. 1 and 2, an electric eye 388 is associated with the spider feeder 52 and detects the presence of envelopes 50 within the slots 70. The signals generated by the electric eye enable the control 386 to count the number of envelopes entering the stacking zone 272 (see FIG. 5) to enable the control to actuate the hold back fingers 54 to project into the stacking zone 272 to begin a new stack.

As shown in FIGS. 2 and 3, the mounting channel 136 of the transfer fingers 58 includes a trip-plate 390 which is positioned adjacent to a proximity switch 392 mounted on the frame 116. When the transfer fingers 56 have been lowered by double-acting cylinder 176 to the point where the proximity switch is tripped 40, the control 386 actuates the conveyor 36 to index the bucket, now loaded with a stack 48, forwardly out of the stacking zone 272.

As explained previously, a proximity switch 270 is tripped when a misfeed occures in which a stack of envelopes is lofted such that the L-shaped members 260, 262 are pivoted about the axle 258. This signal causes the control 386 to stop the stacking process.

A photo cell 394 is positioned above the conveyor and slightly outwardly of it for detecting the presence of a stack 48 adjacent to the double-acting cylinder 276. When a stack 48 actuates the photocell 394, the control 386 actuates the double-acting cylinder 276 to displace the stack through the chute 282 and into the carton 302 (see FIG. 1).

A photocell 396 is positioned above the gate members 292, 294, and detects the return stroke of the double-acting cylinder 276. When photocell 396 is actuated, the control 386 activates the rotary actuators to pivot the gate members 292, 294 to a closed position shown in FIG. 11. Limit switches 398, 400 are mounted internally of the double-acting cylinder motor 276, and signal the control 386 when the rod 280 has reached the limits of its stroke. When the rod 280 is fully extended, the control 386 is signalled to begin the return stroke. When the rod 280 is fully retracted, the control 386 is signalled to index the conveyor 36.

Although the carton machine 300 is of a type known in the art, in the preferred embodiment it has been modified to include a photocell 402 which detects the presence of a set-up carton 302 adjacent to the ram plate 310 (see FIG. 1). The presence of a set-up carton 302 as shown in FIG. 1 signals the control 386 to actuate the ram 274 to displace the stack 48 of envelopes into the set-up carton 302.

CARTON

Figure 15:
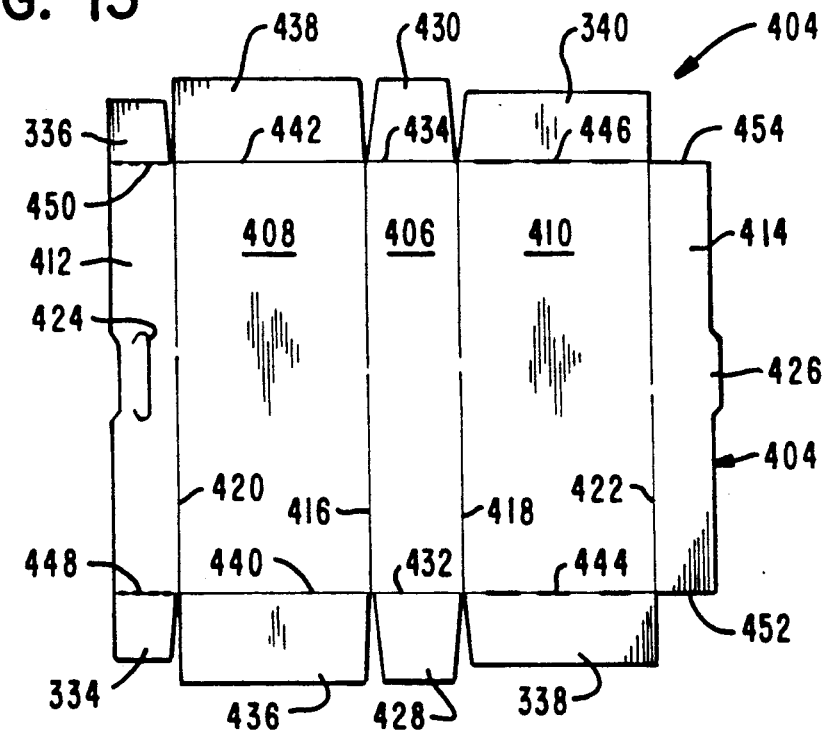
FIG. 15 is a top plan view of a box blank used to form a carton of the type shown in FIG. 1.

As shown in FIG. 15, the carton used with the envelope handling system previously described is made from a blank 404. Blank 404 includes a bottom panel 406, side panels 408, 410, and partial top panel 412, 414. The side panels 408, 410 are connected to the bottom panel 406 along longitudinal score lines 416, 418, respectively. Partial top panel 412 is connected to side panel 408 at a longitudinal score line 420, and partial top panel 414 is connected to side panel 410 at a longitudinal score line 422 extending along its length. Partial top panel 412 includes a slit 424 which is shaped to receive a tab 426 formed in partial top panel 414 when the carton 302 (FIG. 16) is opened and resealed.

Figure 18:
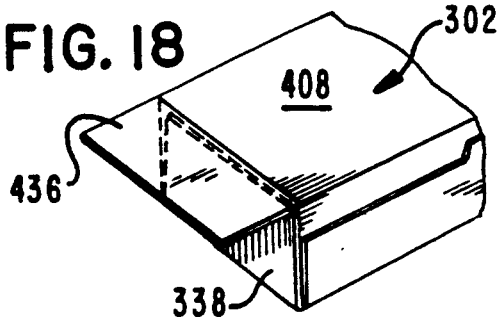

Bottom panel 406 includes front and rear end flaps 428, 430 connected at transverse score lines 432, 434, respectively. Side panel 408 includes front and rear end flaps 436, 438 connected by transverse score lines 440, 442, respectively. Side panel 410 includes front and rear end flaps 338, 340 connected by transverse score lines 444, 446, respectively. In the preferred embodiment, flaps 338, 340 are slightly shorter in length than flaps 436, 438, to provide clearance with side panel 408 when folded as shown in FIG. 18.

Partial top panel 412 includes front and rear end flaps 334, 336, connected by transverse score lines 448, 450, respectively. In contrast, partial top panel 414 is flapless and includes front and rear transverse edges 452, 454, respectively.

Figure 20:
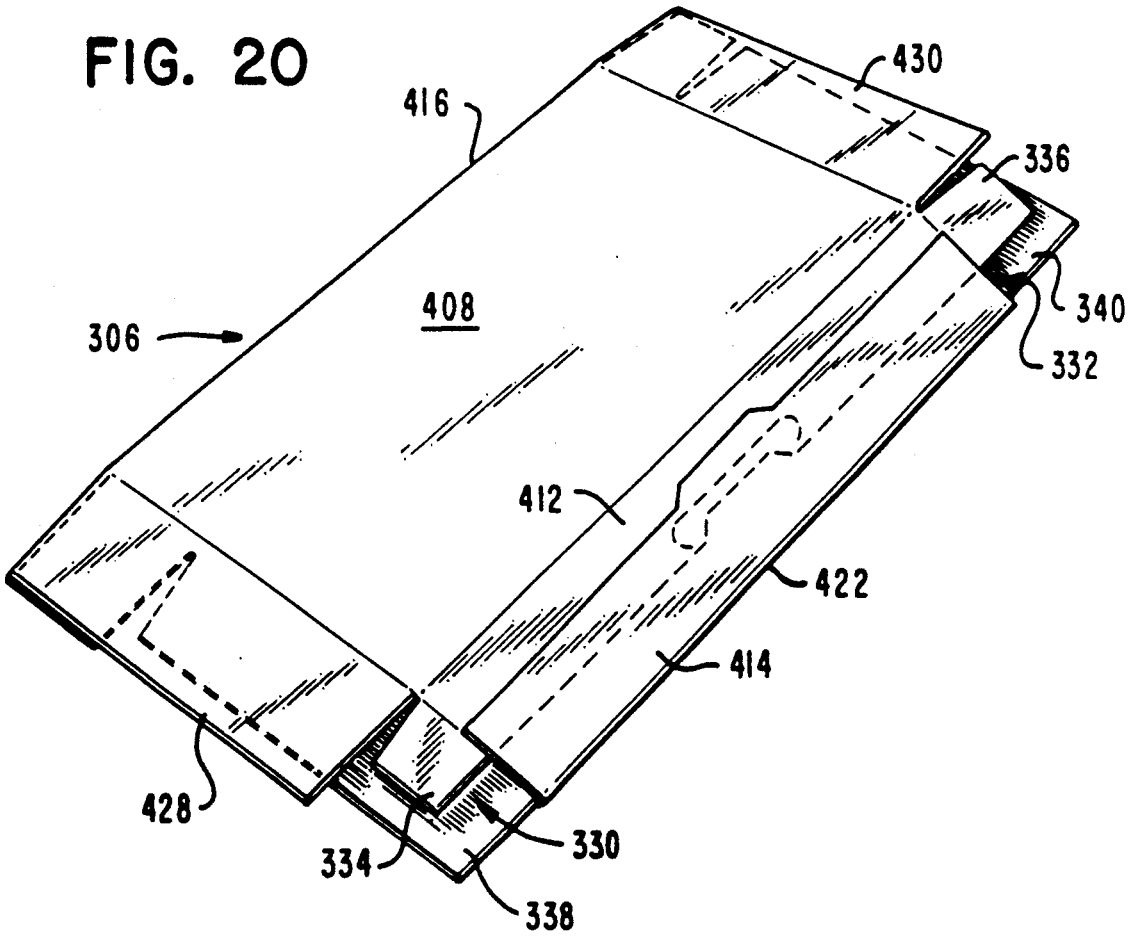
FIG. 20 is a perspective view of an intermediate folded blank of the carton shown in FIG. 1.

The intermediate folded blank is shown in FIG. 20. Side panel 408 is folded at score line 416 to overlie bottom panel 406 and side panel 410. Partial top panel 414 is folded at score line 422 to partially overlap partial top panel 412. In the resulting intermediate blank 306, gaps 330, 332 are formed between top panel ends flaps 334, 336, and end flaps 338, 340 of side panel 310.

Figure 16:
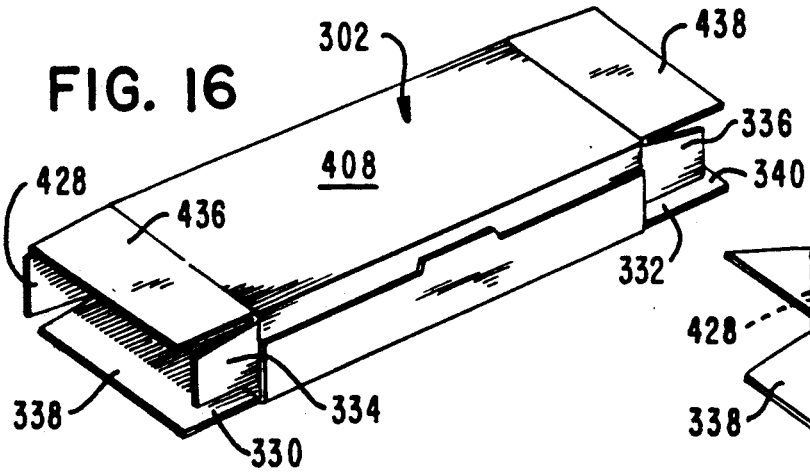
FIGS. 16, 17, 18, and 19 together show the sequence in which the end flaps of the carton of FIG. 1 are folded.

As shown in FIG. 16, the set-up carton 302 is rectangular in transverse cross-section and is positioned on the carton machine 300 (see FIG. 1) such that the gaps 330, 332, face in a downstream direction and extend substantially vertically.

Figure 17:
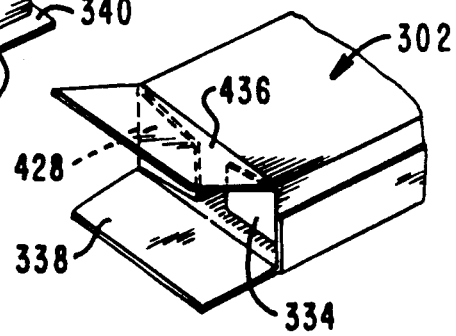
Figure 19:
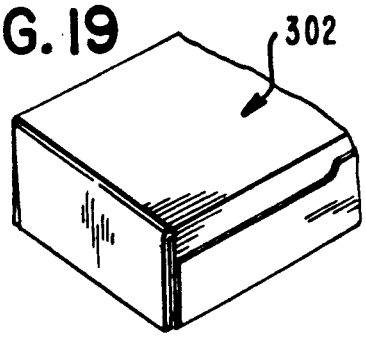

As shown in FIGS. 16, 17, 18, and 19, the end flaps of the car ton 302 are folded in the following order. For purposes of expediency, FIGS. 17–19 illustrate only the front portion of the carton 302, it being understood that the appearance and order of flap closing for the rear portion is identical. As shown in FIG. 1, the bottom panel end flaps 428, 430 are first closed by the front and rear tucker bars 318, 320 of the carton machine 300. The fingers 328 of the tucker bar extend to a point adjacent to the folding rails 314 of the carton machine, so that as the carton 302 is urged into that portion of the machine, the bottom panel end flaps 428, 430 remain closed. The folding rails 314 of the sealing component 316 next fold the top panel end flaps 334, 336. The sealing component 316 then proceeds to fold side panel end flaps 338, 340, then end flaps 436, 438. The sealing machine seals the flaps with an appropriate adhesive. As the sealed carton 302' are indexed upwardly within the sealing machine 316 the glue sealing the flaps has an opportunity to cool and harden.

The advantage of the specific design of the box blank 404, intermediate folded blank 306, and set-up carton 302 is that the top panel end flaps 334, 336 form gaps 330, 332 with the side panel end flaps 340 which allow the fingers 328 of the tucker bars 318, 320 to extend through and beyond the set-up carton 302 to a point immediately adjacent to the downstream folding rails 314 of the sealing component 316. It is preferable that only the downstream end flaps 334, 336 form a gap with the side panel end flaps 338, 340 since the end flaps 428, 430 must be contacted by the tucker bars and form an appropriate closure for the carton 302.

While the form of apparatus herein described constitutes a preferred embodiment of this invention, it is to be understood that the invention is not limited to this precise form of apparatus, and that changes may be made therein without departing from the scope of the invention.

What is claimed is:

1. A method for stacking sheet-like articles in stacks of predetermined number in a stacking zone comprising, in order, the steps of:

(a) continuously releasing said articles from an upper level conveyor to fall, seriatim, into said stacking zone;

(b) collecting said articles in a first stack on a first pivotal, counterbalanced collecting surface in said stacking zone, whereby said first surface pivots downwardly in response to increasing weight of said first stack such that said articles thereof are collected at substantially the same elevation;

(c) interrupting said fall of articles to said first stack by projecting a second pivotal, counterbalanced collecting surface into said stacking zone, whereby said second surface pivots downwardly in response to increasing weight of said first stack such that said articles thereof are collected at substantially the same elevation;

(d) urging said first stack and said first collecting surface to pivot downwardly below said stacking zone to lower level conveying zone and displacing said first stack sidewardly therefrom, whereby said first surface pivots upwardly to said stacking zone to coincide with said second surface;

(e) withdrawing said second collecting surface from said stacking zone whereby said second stack continues to collect, uninterrupted, on said first surface; and (f) continuing to collect articles in said second stack by repeating steps (a) and (b) as for said first stack, and forming a third stack by repeating steps (c), (d) and (e) as for said second stack.

2. The method of claim 1 wherein said urging step (d) includes applying a downward force to a topmost article of said first stack sufficient to compress said first stack and urge said first surface to pivot downwardly to said conveying zone.

* * * * *